US007669723B2

(12) United States Patent
Kao

(10) Patent No.: US 7,669,723 B2
(45) Date of Patent: Mar. 2, 2010

(54) TOOL SUSPENSION DEVICE

(76) Inventor: Jui-Chien Kao, No. 358, Tunghsing Rd., Shuwang Li, Tali City, Taichung Hsien (TW)

( * ) Notice: Subject to any disclaimer, the term of this patent is extended or adjusted under 35 U.S.C. 154(b) by 327 days.

(21) Appl. No.: 11/866,640

(22) Filed: Oct. 3, 2007

(65) Prior Publication Data

US 2009/0090644 A1 Apr. 9, 2009

(51) Int. Cl.
*A47F 7/00* (2006.01)

(52) U.S. Cl. ..... 211/70.6; 211/69; 211/89.01; 211/60.1; 211/87.01; 211/94.01; 206/349

(58) Field of Classification Search ..... 211/17, 211/69, 70.6, 89.01, 85.7, 60.1, 64, 66, 68, 211/70.4, 70.8, 85.13; 296/37.6, 37.7; 206/373, 206/378, 349, 372, 376; 269/43, 309, 310; 248/354.7, 113, 354.4; *A47F 7/00*
See application file for complete search history.

(56) References Cited

U.S. PATENT DOCUMENTS 2,695,105 A * 11/1954 Mitchell ..... 211/35
4,705,177 A * 11/1987 Oren ..... 211/70.5
5,163,633 A * 11/1992 Watkins ..... 242/532.6
5,398,823 A * 3/1995 Anders ..... 211/70.6
6,152,435 A * 11/2000 Snell ..... 269/43
6,386,363 B1 * 5/2002 Huang ..... 206/378
6,488,151 B2 * 12/2002 Ramsey et al. ..... 206/378
6,564,949 B1 * 5/2003 Saathoff ..... 211/70.6
6,626,402 B1 * 9/2003 Kaminstein ..... 248/110
6,637,605 B2 * 10/2003 Ernst ..... 211/70.6
6,775,893 B2 * 8/2004 Constantinescu ..... 29/281.5
7,198,158 B2 * 4/2007 Kao ..... 211/70.6
7,451,968 B2 * 11/2008 Geldert ..... 269/258
7,591,385 B2 * 9/2009 Brooks ..... 211/94.01
2006/0234846 A1 * 10/2006 Tucker ..... 483/26
2008/0000853 A1 * 1/2008 Huang ..... 211/70.6
2008/0047911 A1 * 2/2008 Kao ..... 211/70.6

* cited by examiner

*Primary Examiner*—Sam Chuan C Yao
*Assistant Examiner*—Patrick Hawn
(74) *Attorney, Agent, or Firm*—Burr & Brown

(57) ABSTRACT

A tool suspension device has a base bracket having a front surface, a rail bracket and multiple clamps. The rail bracket is attached securely to the front surface of the base bracket has a mounting panel, two opposite rails and two opposite channels. The channels are formed respectively in inner surfaces of the rails. The clamps are mounted slidably in pairs on the rails and in the channels and each clamp comprises a fastener to hold the clamps securely in position, the pairs of clamps clamp a tool securely.

17 Claims, 10 Drawing Sheets

TOOL SUSPENSION DEVICE

BACKGROUND OF THE INVENTION

1. Field of the Invention

The present invention relates to a tool suspension device, especially to a tool suspension device that holds tools more securely.

2. Description of the Prior Arts

Tool suspension devices are used to hold tools such as wrenches and screwdrivers on a wall. A conventional suspension device comprises a bracket and multiple holders. The bracket has upper and lower rails with multiple ratchets. The holders are clamped slidably on the bracket and have multiple pawls. The pawls correspond to and selectively engage the ratchets. When a tool is clamped between adjacent holders, the pawls engage the ratchets to hold the holders in position.

However, because an interval between adjacent ratchets is fixed, the interval between adjacent holders can only be changed at several predetermined distances. Therefore, the interval between adjacent holders does not precisely match the width of the clamped tool, therefore preventing the tool from being clamped tightly between adjacent holders.

Furthermore, because the holders only depend on the engagement between pawls and ratchets to be held on the bracket, the holders are easily moved by persons bumping into the bracket, vibration or the like.

To overcome the shortcomings, the present invention provides a tool suspension device to mitigate or obviate the aforementioned problems.

SUMMARY OF THE INVENTION

The main objective of the present invention is to provide a tool suspension device that holds tools securely. The tool suspension device A tool suspension device has a base bracket having a front surface, a rail bracket and multiple clamps. The rail bracket is attached securely to the front surface of the base bracket has a mounting panel, two opposite rails and two opposite channels. The channels are formed respectively in inner surfaces of the rails. The clamps are mounted slidably in pairs on the rails and in the channels and each clamp comprises a fastener to hold the clamps securely in position, the pairs of clamps clamp a tool securely.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
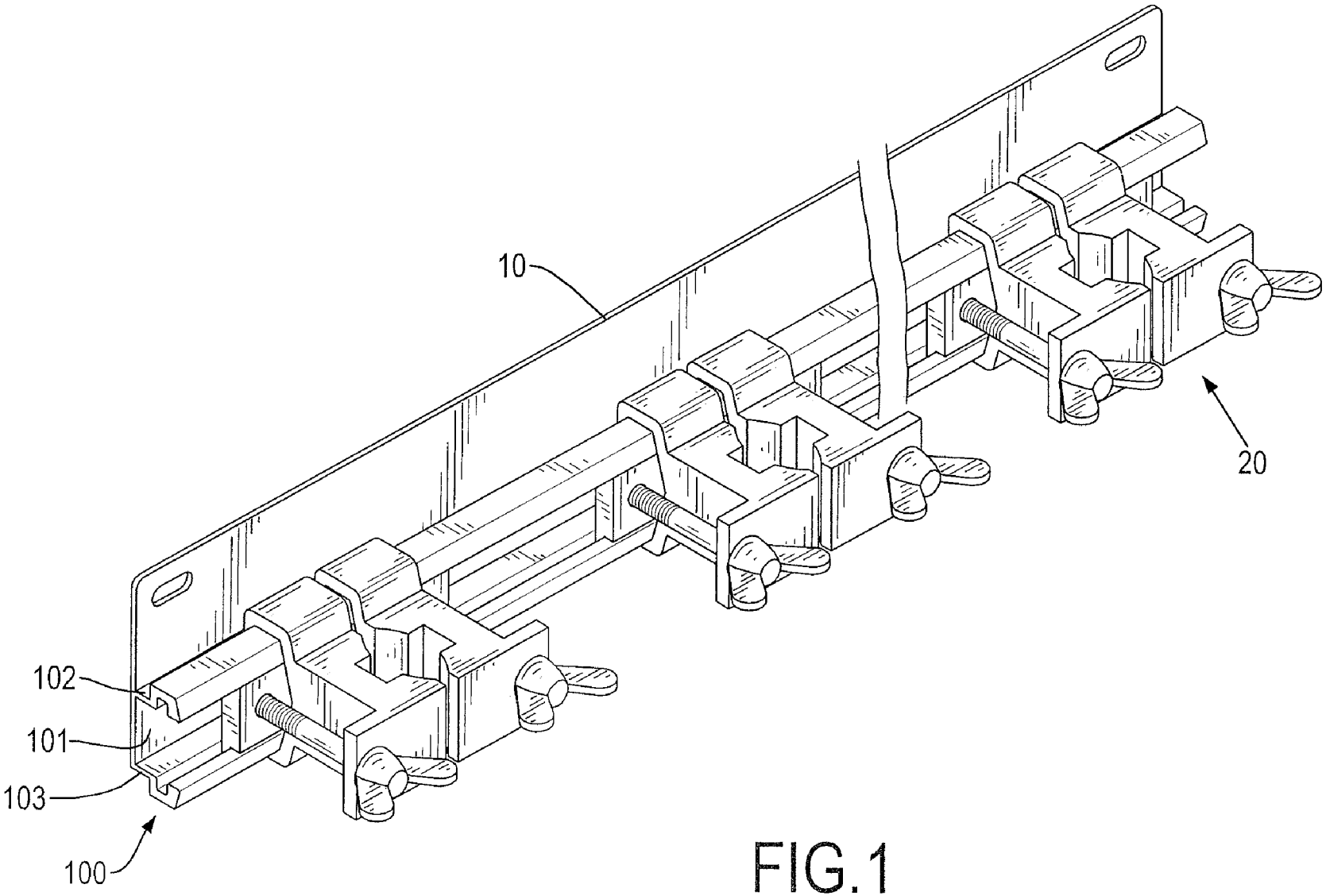
FIG. 1 a perspective view of a tool suspension device in accordance with the present invention.
Figure 2:
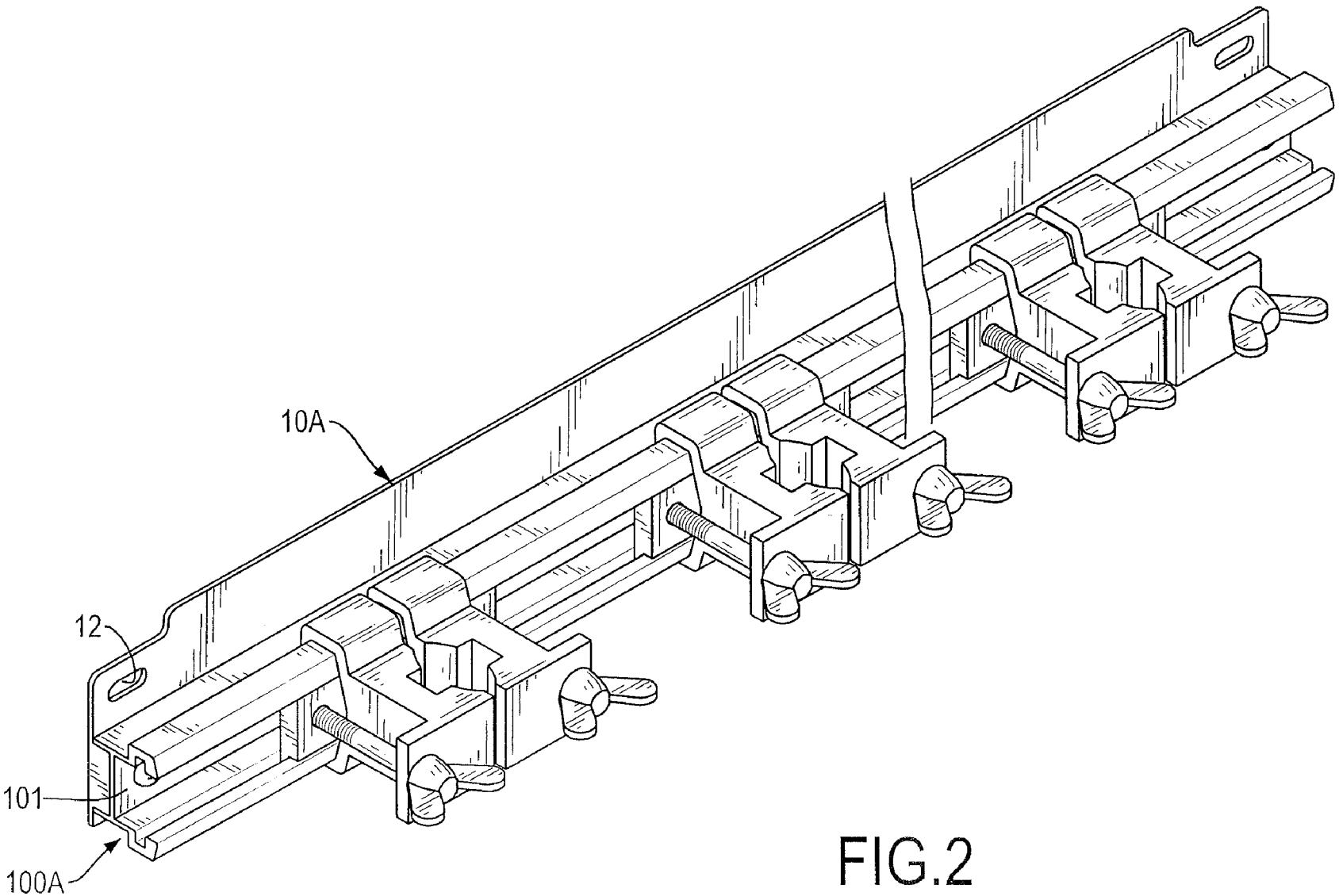
FIG. 2 is a perspective view of another embodiment of a tool suspension device in accordance with the present invention.
Figure 3:
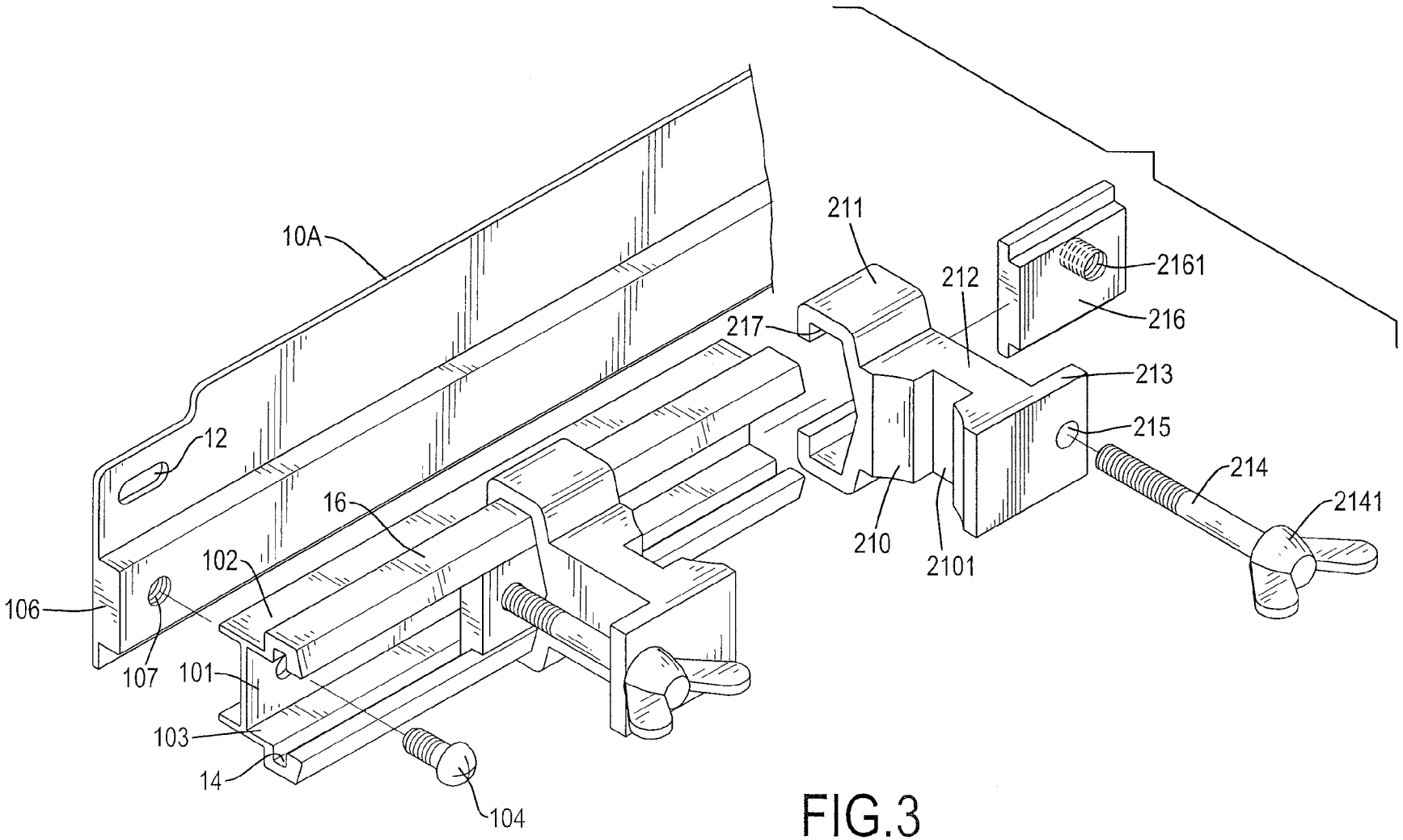
FIG. 3 is an enlarged, partially exploded perspective view of the tool suspension device in FIG. 2.

With reference to FIGS. 1, 2 and 3, a tool suspension device in accordance with the present invention comprises a base bracket (10, 10A), a rail bracket (100, 100A) and multiple clamps (20).

Figure 10:
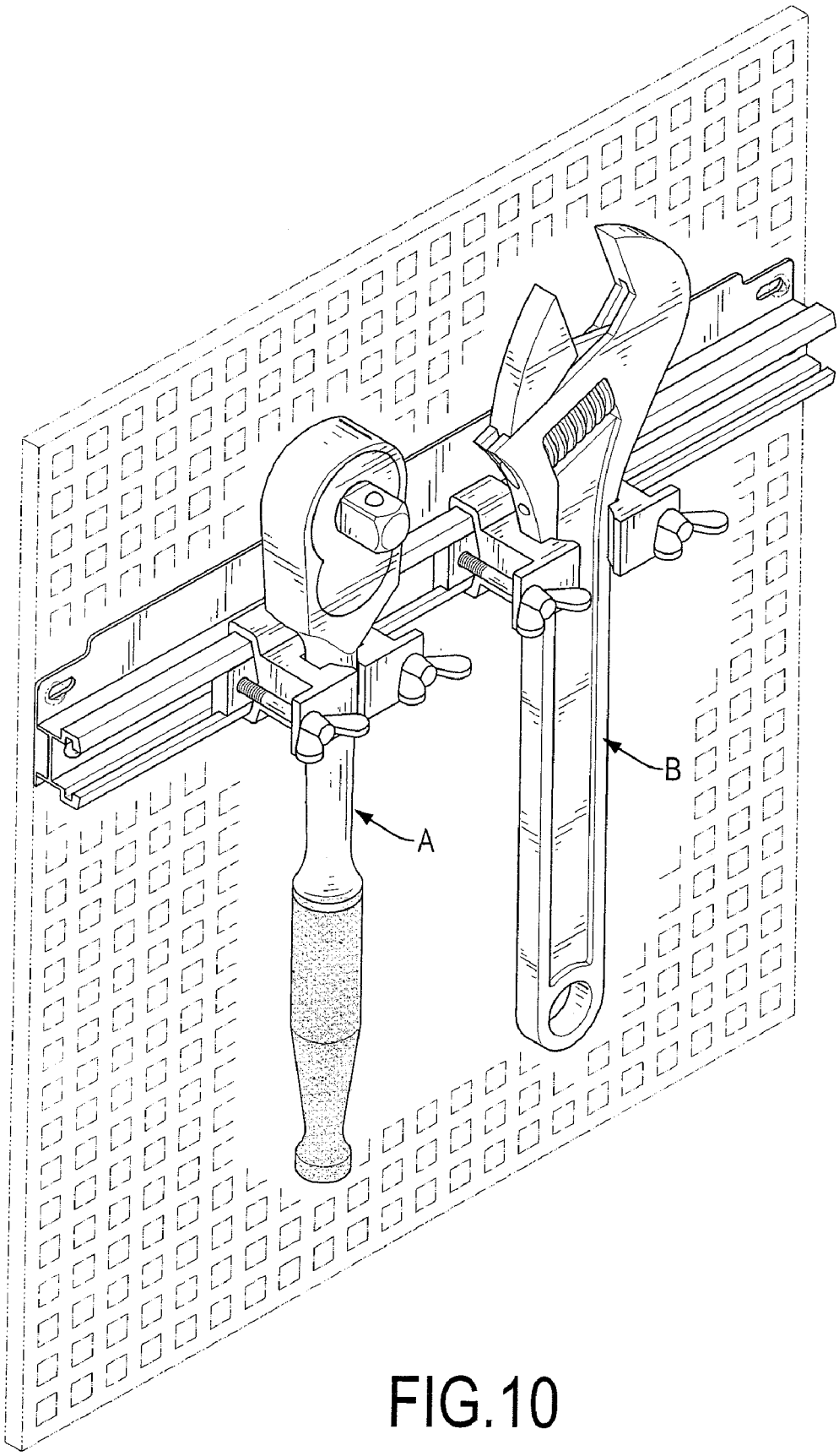
FIG. 10 is an operational perspective view of the tool suspension device in FIG. 2 hung on a perfboard with the socket wrench and the monkey wrench.

With further reference to FIG. 10, The base bracket (10, 10A) is hung on a mounting surface such as perfboard or a wall, has a front surface multiple hanging holes (12) and may comprise a longitudinal mounting protrusion (106).

The hanging holes (12) are formed through the base bracket (10, 10A).

The longitudinal mounting protrusion (106) is formed on and protrudes from the front surface of the base bracket (10A) and comprises multiple fastening holes (107) formed in the mounting protrusion (106).

The rail bracket (100, 100A) is attached securely to the front surface of the base bracket (10, 10A) and comprises a mounting panel (101), multiple optional fasteners (104), top and bottom panels (102), two rails (16) and two channels (14).

The mounting panel (101) may be formed on the front surface of the base bracket (10) or may be mounted on the front surface of the base bracket (10), has a front surface, a rear surface, a top, and a bottom. When the mounting panel (101) is mounted on the front surface of the base bracket (10), the mounting panel (101) may have a mounting cavity (106). The longitudinal mounting cavity is U-shaped and formed on the rear surface of the mounting panel (101), corresponds to and is mounted securely on the longitudinal mounting protrusion (106).

The fasteners (104) extend through the mounting panel (101) and are mounted securely in the fastening holes (107) of the longitudinal mounting protrusion (106) to mount the main panel (101) securely on the mounting rib (106).

The top and bottom panels (102,103) are formed respectively on and protrude from the front surface at the top and bottom of the mounting panel (101) and each having a front edge.

The rails (16) are formed on the front edges of the top and bottom panels (102, 103) and each rail (16) has an outer surface and an inner surface. The inner surfaces of the rails (16) face one another.

The channels (14) are formed respectively in the inner surfaces of the rails (16).

Figure 4:
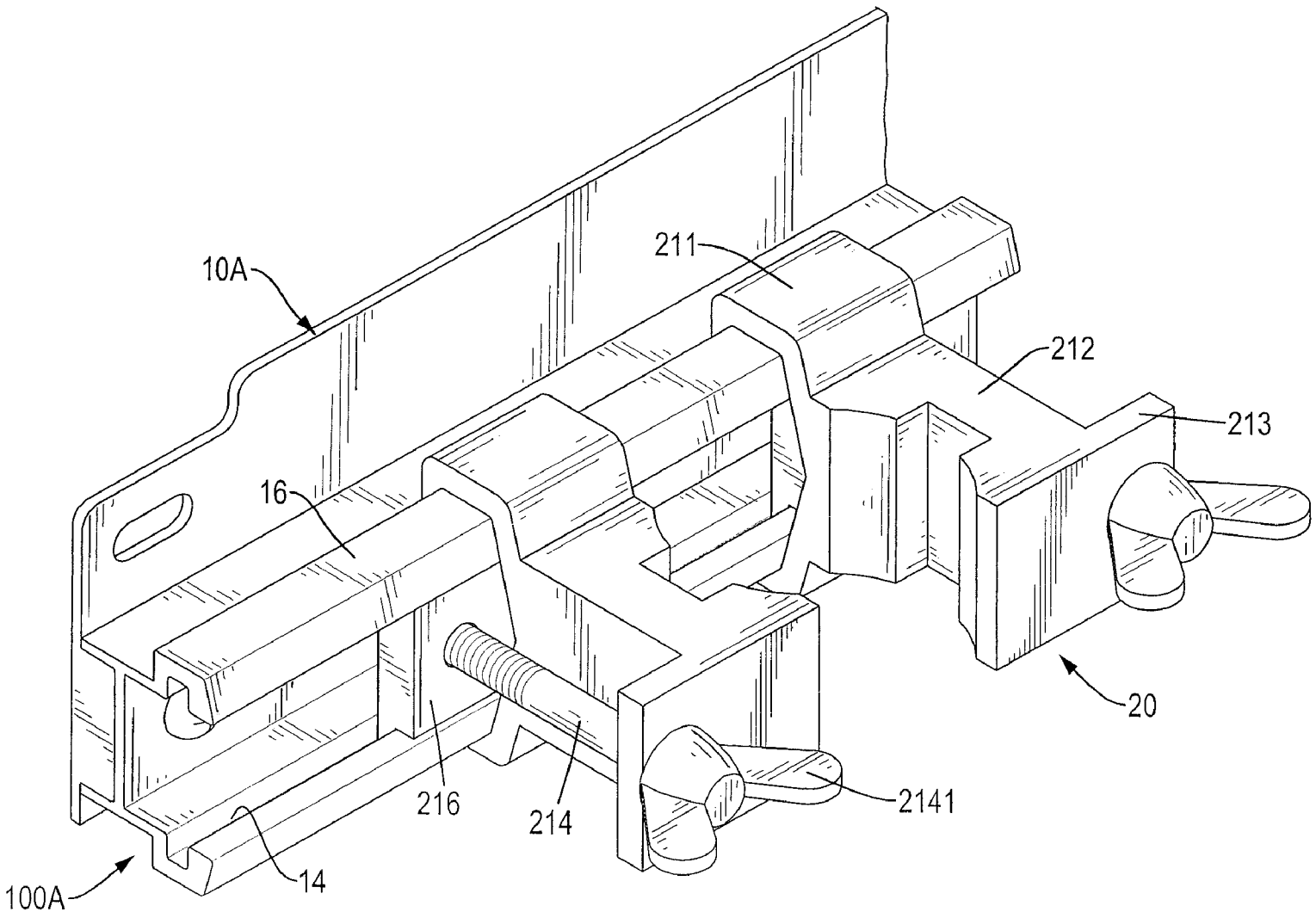
FIG. 4 is an enlarged operational perspective view of the tool suspension device in FIG. 2, shown open.
Figure 5:
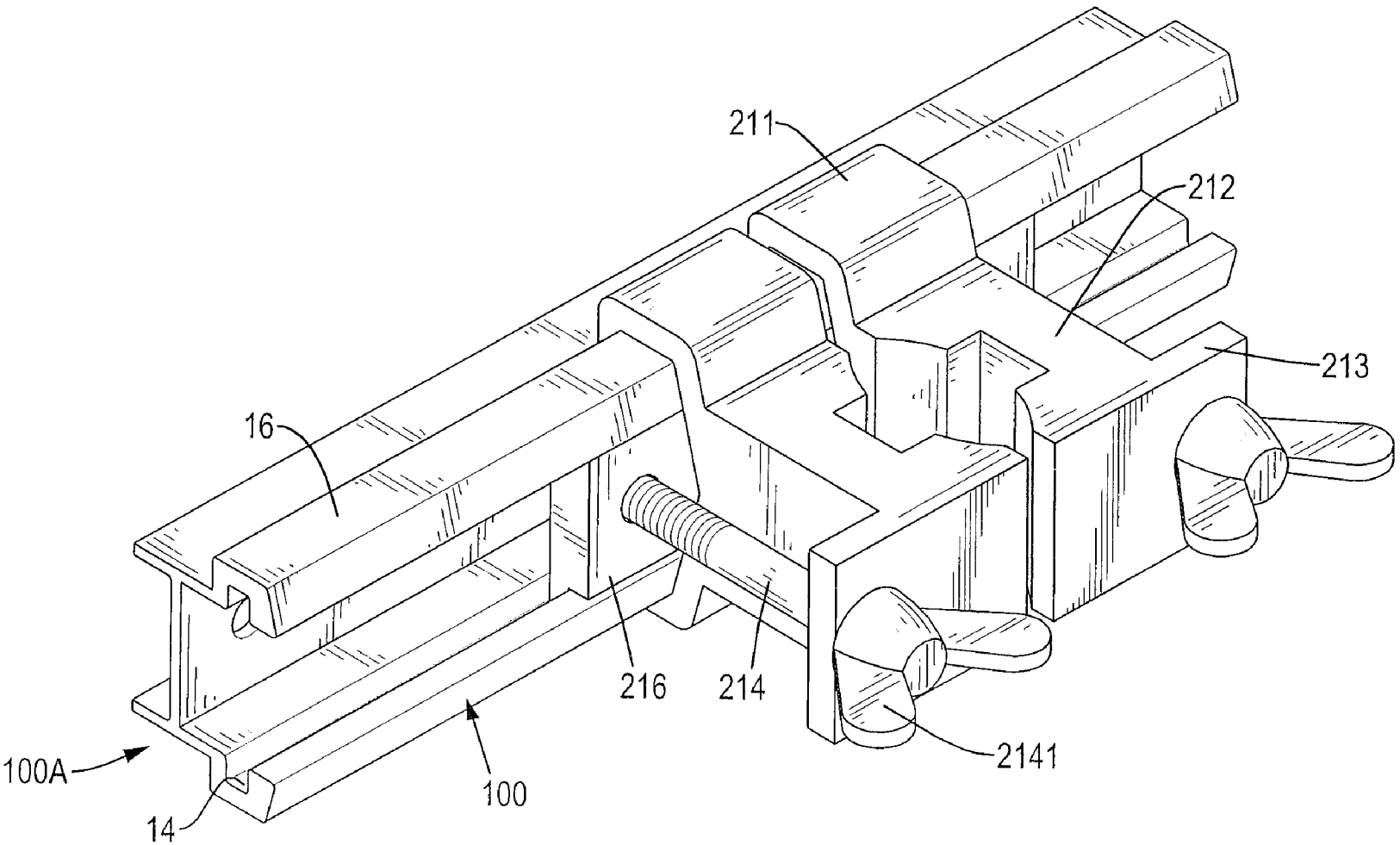
FIG. 5 is an enlarged operational perspective view of the tool suspension device in FIG. 2, shown closed.

With further reference to FIGS. 4 and 5, the clamps (20) are slidably mounted in pairs on the rails (16) and in the channels (14). Each clamp (20) comprises two legs (211), an arm (212), a clamping plate (216) and a fastener (214).

The legs (211) correspond to and are mounted slidably around the rails (16), has an inner surface and an outer surface and may have two grooves (217). The inner surface has an upper part and a lower part respectively corresponding to the rails (16). The grooves (217) are formed respectively in the upper and lower parts of the inner surface of the clamp (211) and slide and clamp respectively on the rails (16).

The arm (212) is formed on and protrudes out from the legs (211), has a free end, an inner surface, an outer surface, a jaw (210) and may have a jaw recess (2101), a fastening protrusion (213) and a through hole (215).

The inner surfaces of the arms (212) of the pair of clamps (20) face one another.

The jaw (210) is formed in the inner surface of the arm (212, 222), correspond to the jaw (210) of the other clamp (20) and may be curved.

The jaw recess (2101) is formed in the jaw (210), corresponds to the jaw recess (2101) of the other clamp (20) and may be quadrangular.

The fastening protrusion (213) is formed on and protrudes transversely out from outer surface at the free end of the arm (212).

The through hole (215) is formed through the fastening protrusion (213).

Figure 6B:
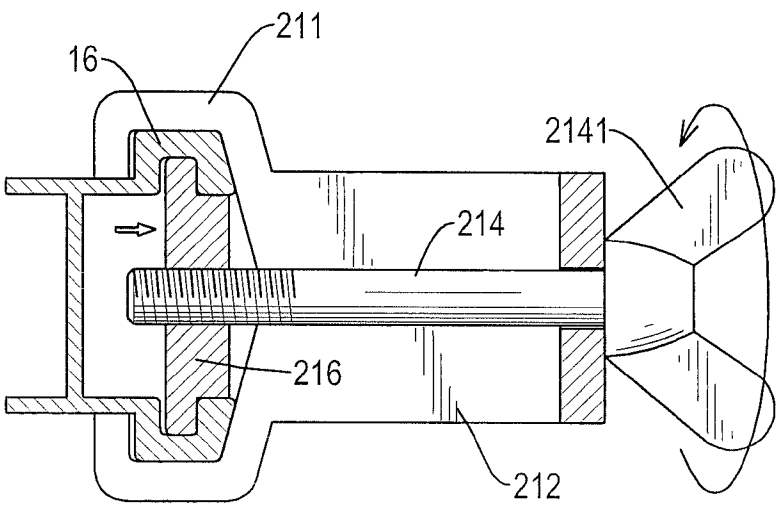
FIGS. 6*a* and 6*b* are enlarged operational side views in partial section of the tool suspension device in FIG. 2, showing loosing and tightening a holder.
Figure 6A:
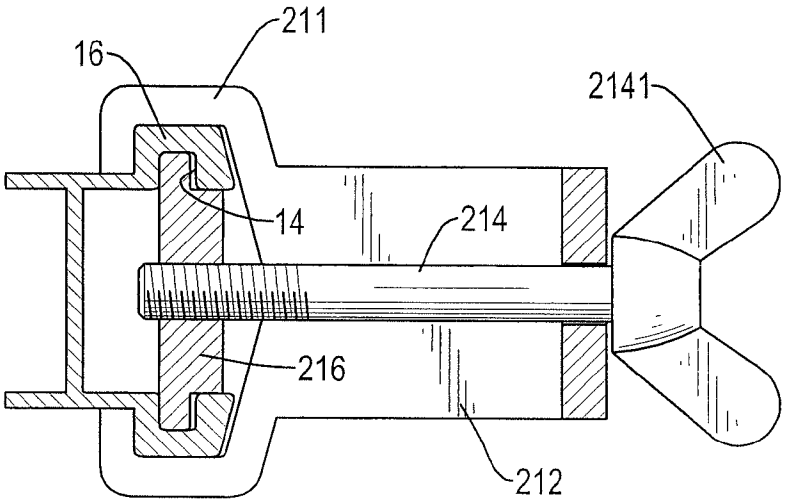
Figure 7B:
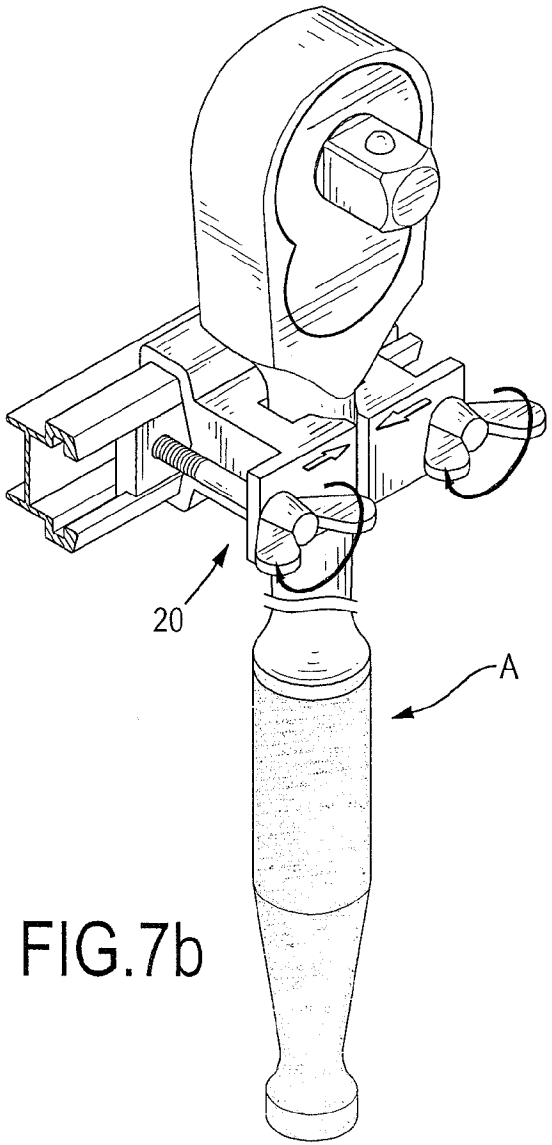
FIGS. 7*a* and 7*b* are operational perspective views of the tool suspension device in FIG. 2, with a socket wrench.
Figure 7A:
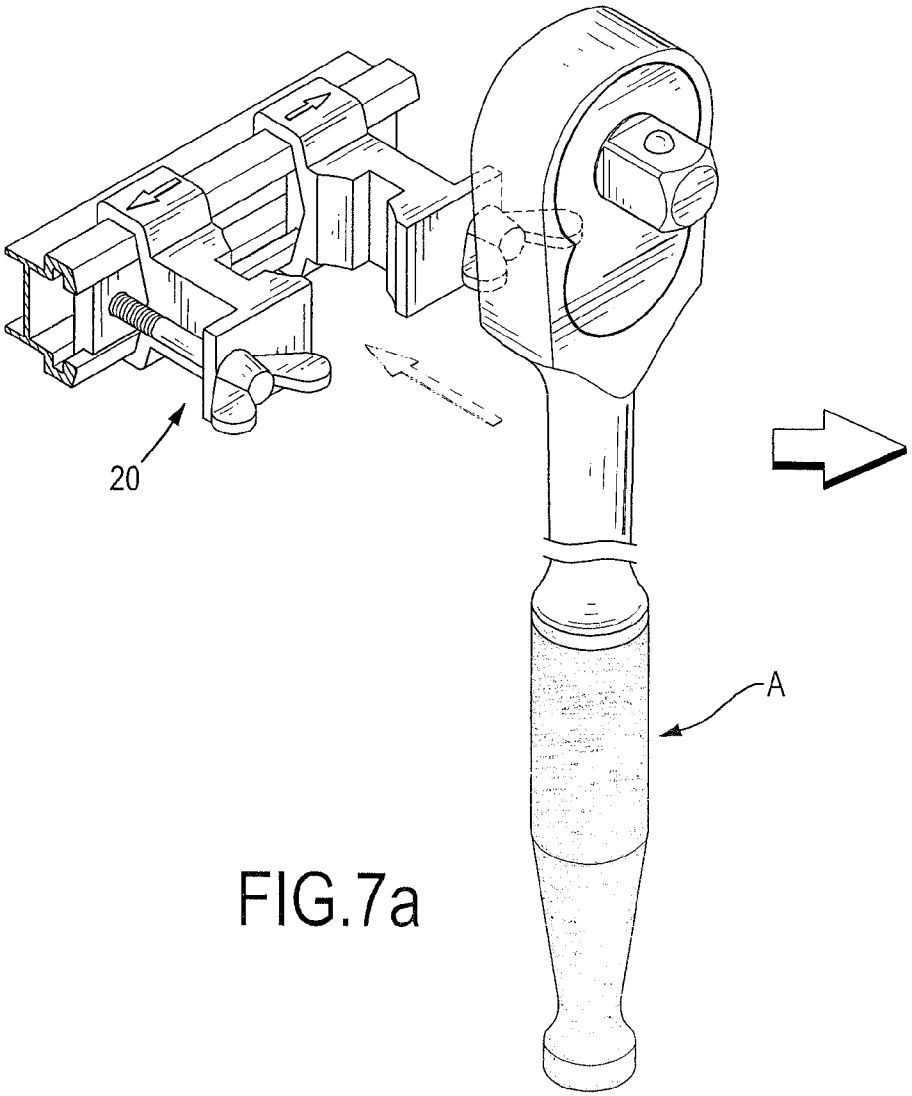
Figure 8A:
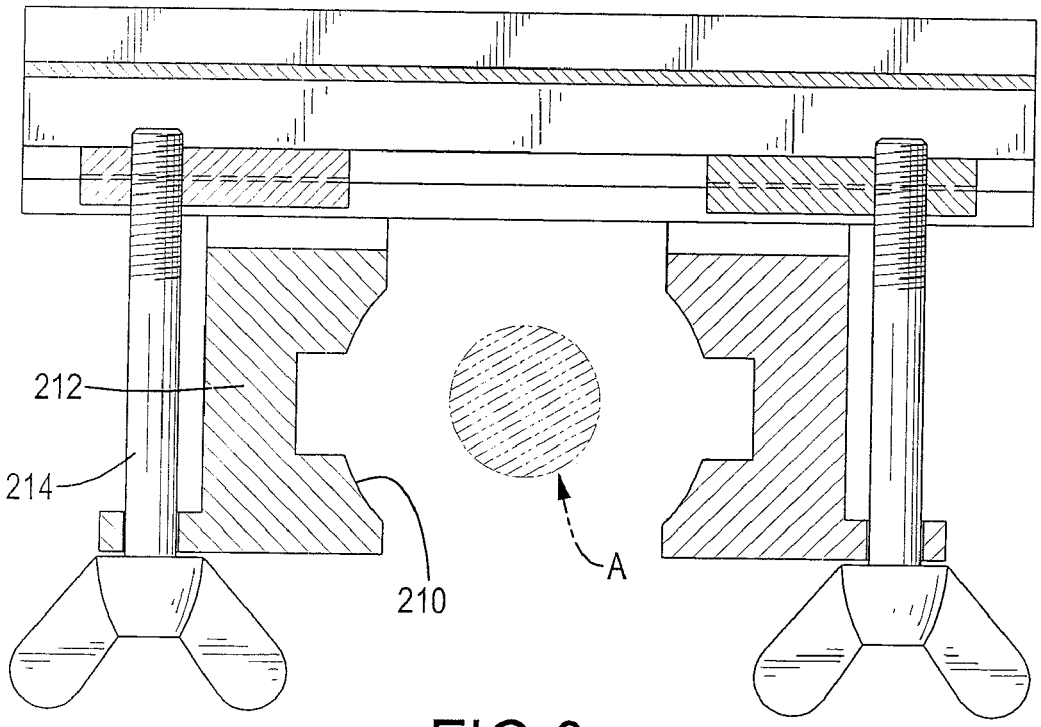
FIGS. 8*a* and 8*b* are operational top views in partial section of the tool suspension device in FIG. 2, with the socket wrench.
Figure 8B:
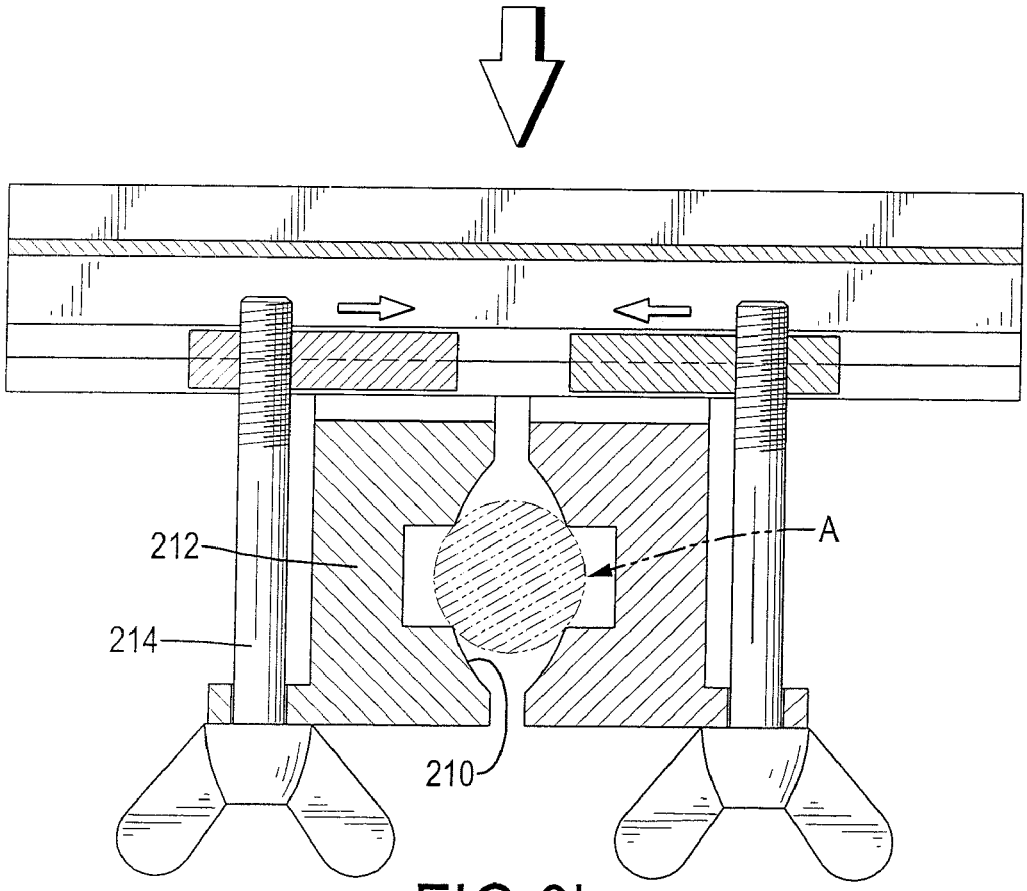
Figure 9A:
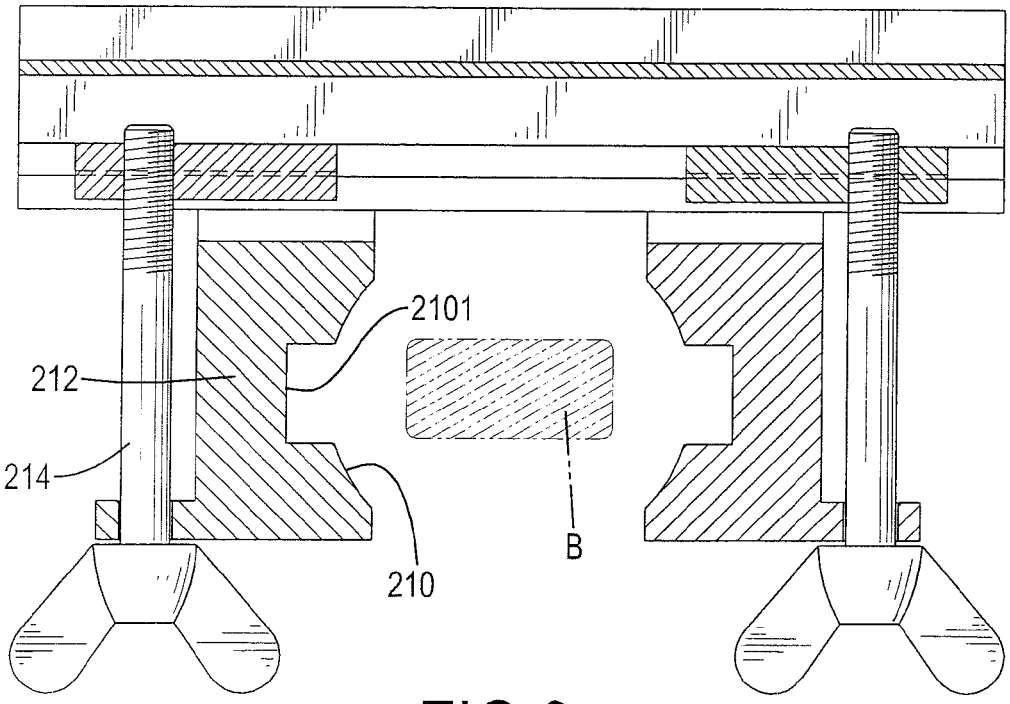
FIGS. 9*a* and 9*b* are operational top views in partial section of the tool suspension device in FIG. 2 with a monkey wrench.
Figure 9B:
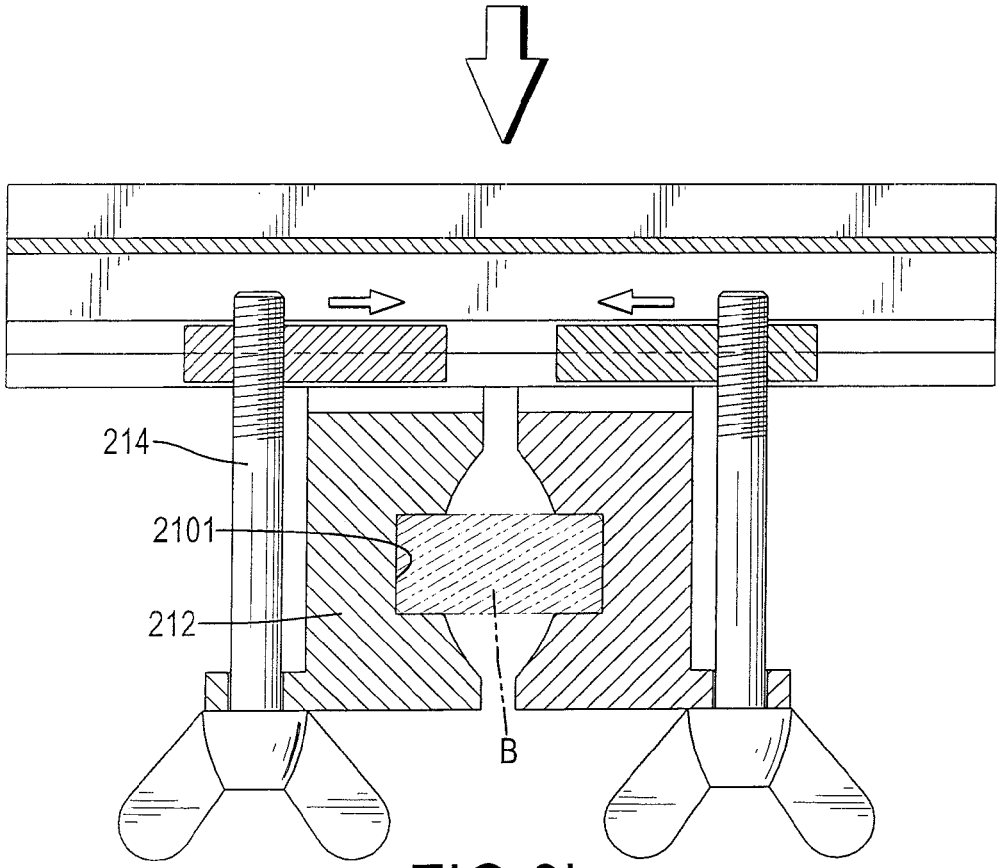

With further reference to FIGS. 6*a* and 6*b*, each clamping plate (216) is mounted slidably in the channels (14) and has a fastening hole (2161). The fastening hole (2161) is formed through the clamping plate (216) and may align with the through hole (215) of the clamp (20). The fastening hole (2161) may be a threaded hole.

The fastener (214) extends through the free end of the clamp (20), may extend through the through hole (215) of the clamp (20) and is mounted securely in the fastening hole (2161) of the clamping plate (216) and has a head (2141). The fastener (214) may be a butterfly bolt or the like. The head (2141) selectively abuts the free end of the arm (212) of the clamp (20) and may selectively abut the fastening protrusion (213) of the clamp (20) to prevent the clamp (20) from moving.

With further reference to FIGS. 7*a* to 10, a socket wrench (A) and a monkey wrench (B) are clamped between the clamps (20). When the fasteners (214) are loosened, the clamps (20) may be slid away from each other to allow the wrench (A, B) to be placed between the clamps (20). Then the clamps (20) are toward one another to clamp the wrenches (A, B) in the jaws (210) or in the jaw recesses (2101). By tightening the fasteners (214) the clamps (20) are held securely. Therefore, the tool suspension device as described holds the wrenches (A, B) more securely.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A tool suspension device comprising:

a base bracket having a front surface;

multiple hanging holes being formed through the base bracket;

a rail bracket being attached securely to the front surface of the base bracket and comprising a mounting panel having a front surface, a rear surface, a top and a bottom;

top and bottom panels being formed respectively on and protruding from the front surface at the top and bottom of the mounting panel and each having a front edge;

two rails being formed on the front edges of the top and bottom panels and each rail having an outer surface and an inner surface wherein the inner surfaces of the rails face one another; and two channels formed respectively in the inner surfaces of the rails; and multiple clamps being slidably mounted in pairs on the rails, and in the channels and each clamp having two legs corresponding to and being mounted slidably around the rails;

an arm being formed on and protruding out from the legs and having a free end;

an inner surface, wherein the inner surfaces of the arms of the pair of clamps face one another;

an outer surface; and a jaw being formed in the inner surface of the arm, wherein the jaws of the pair of clamps correspond to each other;

a clamping plate being mounted slidably in the channels and having a fastening hole formed through the clamping plate; and a fastener extending through the free end of the clamp and mounted securely in the fastening hole of the clamping plate and having a head selectively abutting the free end of the arm of the clamp to prevent the clamp from moving.

2. The tool suspension device as claimed in claim 1, wherein the base bracket further comprises a longitudinal mounting protrusion being formed on and protruding from the front surface of the base bracket and having multiple fastening holes formed in the mounting protrusion;

the mounting panel of the rail bracket further comprises a longitudinal mounting cavity being U-shaped and formed on the rear surface of the mounting panel, corresponding to and being mounted securely on the longitudinal mounting protrusion; and the rail bracket further comprises multiple fasteners extending through the mounting panel and in the fastening holes of the longitudinal mounting protrusion.

3. The tool suspension device as claimed in claim 1, wherein the mounting panel is formed on the front surface of the base bracket.

4. The tool suspension device as claimed in claim 1, wherein the arm of each clamp further has a fastening protrusion being formed on and protruding transversely out from the outer surface at the free end of the arm; and a through hole being formed through the fastening protrusion;

each bolt extends through the through hole of a corresponding arm;

the head of each bolt selectively abuts the fastening protrusion of the corresponding arm; and the fastening hole in each clamping plate aligns with the through hole in a corresponding arm.

5. The tool suspension device as claimed in claim 2, wherein the arm of each clamp further has a fastening protrusion being formed on and protruding transversely out from the outer surface at the free end of the arm; and a through hole being formed through the fastening protrusion;

each bolt extends through the through hole of a corresponding arm;

the head of each bolt selectively abuts the fastening protrusion of the corresponding arm; and the fastening hole in each clamping plate aligns with the through hole in a corresponding arm.

6. The tool suspension device as claimed in claim 3, wherein the arm of each clamp further has a fastening protrusion being formed on and protruding transversely out from the outer surface at the free end of the arm; and a through hole being formed through the fastening protrusion;

each bolt extends through the through hole of a corresponding arm;

the head of each bolt selectively abuts the fastening protrusion of the corresponding arm; and the fastening hole in each clamping plate aligns with the through hole in a corresponding arm.

7. The tool suspension device as claimed in claim 4, wherein each fastening hole of the clamping plate is a threaded hole; and each fastener is a butterfly bolt.

8. The tool suspension device as claimed in claim 5, wherein each fastening hole of the clamping plate is a threaded hole; and each fastener is a butterfly bolt.

9. The tool suspension device as claimed in claim 6, wherein each fastening hole of the clamping plate is a threaded hole; and each fastener is a butterfly bolt.

10. The tool suspension device as claimed in claim 1, wherein each jaw of each clamp is curved; and each clamp has a quadrangular jaw recess formed in the jaw of the clamp wherein the jaw recesses of the pair of clamps correspond to each other.

11. The tool suspension device as claimed in claim 7, wherein each jaw of each clamp is curved; and each clamp has a quadrangular jaw recess formed in the jaw of the clamp, wherein the jaw recesses of the pair of clamps correspond to each other.

12. The tool suspension device as claimed in claim 8, wherein each jaw of each clamp is curved; and each clamp has a quadrangular jaw recess formed in the jaw of the clamp, wherein the jaw recesses of the pair of clamps correspond to each other.

13. The tool suspension device as claimed in claim 9, wherein each jaw of each clamp is curved; and each clamp has a quadrangular jaw recess formed in the jaw of the clamp, wherein the jaw recesses of the pair of clamps correspond to each other.

14. The tool suspension device as claimed in claim 1, wherein each leg has an inner surface having an upper part and a lower part respectively corresponding to the rails;

an outer surface; and two grooves formed respectively in the upper and lower parts of the inner surface of the leg and sliding and clamping respectively on the rails.

15. The tool suspension device as claimed in claim 11, wherein each leg has an inner surface having an upper part and a lower part respectively corresponding to the rails;

an outer surface; and two grooves formed respectively in the upper and lower parts of the inner surface of the leg and sliding and clamping respectively on the rails.

16. The tool suspension device as claimed in claim 12, wherein each leg has an inner surface having an upper part and a lower part respectively corresponding to the rails;

an outer surface; and two grooves formed respectively in the upper and lower parts of the inner surface of the leg and sliding and clamping respectively on the rails.

17. The tool suspension device as claimed in claim 13, wherein each leg has an inner surface having an upper part and a lower part respectively corresponding to the rails;

an outer surface; and two grooves formed respectively in the upper and lower parts of the inner surface of the leg and sliding and clamping respectively on the rails.

* * * * *